US012662888B1

(12) United States Patent
Spahn et al.

(10) Patent No.: US 12,662,888 B1
(45) **Date of Patent: *Jun. 23, 2026**

(54) DEBRIS CATCH FOR MANAGED PRESSURE DRILLING

(71) Applicant: PRUITT TOOL & SUPPLY CO., Fort Smith, AR (US)

(72) Inventors: Benjamin Micah Spahn, Alma, AR (US); John Moreton, Mansfield, AR (US)

(73) Assignee: PRUITT TOOL & SUPPLY CO., Fort Smith, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/990,699

(22) Filed: Dec. 20, 2024

Related U.S. Application Data

(63) Continuation-in-part of application No. 18/314,589, filed on May 9, 2023, now Pat. No. 12,173,568, which is a continuation of application No. 17/325,835, filed on May 20, 2021, now Pat. No. 11,643,889.

(51) Int. Cl.
*E21B 21/06* (2006.01)
*E21B 21/08* (2006.01)
*E21B 21/10* (2006.01)

(52) U.S. Cl.
CPC ..... *E21B 21/065* (2013.01); *E21B 21/08* (2013.01); *E21B 21/106* (2013.01)

(58) Field of Classification Search
CPC ..... E21B 21/065; E21B 21/08; E21B 21/106
See application file for complete search history.

(56) References Cited

U.S. PATENT DOCUMENTS

| | | | | |
|---|---|---|---|---|
| 4,106,562 | A * | 8/1978 | Barnes | E21B 43/35 166/227 |
| 8,127,867 | B1 * | 3/2012 | Droke | E21B 21/065 166/267 |
| 9,388,650 | B2 * | 7/2016 | Leuchtenberg | E21B 47/10 |
| 10,384,154 | B2 * | 8/2019 | Morris | B01D 29/56 |
| 10,415,352 | B2 * | 9/2019 | Thomas | E21B 17/042 |
| 10,590,719 | B2 * | 3/2020 | Gardner | E21B 21/10 |

(Continued)

FOREIGN PATENT DOCUMENTS

| | | | | |
|---|---|---|---|---|
| WO | WO-2019200311 | A1 * | 10/2019 | E21B 43/35 |
| WO | WO-2021079156 | A1 * | 4/2021 | E21B 33/085 |

*Primary Examiner* — Matthew R Buck
(74) *Attorney, Agent, or Firm* — Schrantz Law Firm, PLLC; Stephen D. Schrantz

(57) ABSTRACT

The debris catch provides a strainer located downstream of a rotating control device (RCD) within a flow line. The strainer is located between the RCD and at least one protected component. The strainer limits the debris and other junk that flows to protected components located downstream of the strainer. A first sensor and a second sensor detect the pressure differential between a location before the strainer and at the strainer. The two sensors detect a clog in the strainer. The strainer is removable through an access outlet for clearing the clog and reinstalling a strainer for continued drilling operation. A purge valve located in the system also allows clearing of the strainer by releasing the debris through a purge outlet located on a pathway separate from the pathway to the protected component.

15 Claims, 7 Drawing Sheets

(56) References Cited

U.S. PATENT DOCUMENTS

| | | | | |
|---|---|---|---|---|
| 11,643,889 | B1 * | 5/2023 | Spahn | E21B 21/08 175/66 |
| 12,173,568 | B1 * | 12/2024 | Spahn | E21B 21/08 |
| 2013/0105416 | A1 * | 5/2013 | Whitehead | B01D 29/35 210/348 |
| 2018/0135366 | A1 * | 5/2018 | Olsen | E21B 7/12 |
| 2018/0135371 | A1 * | 5/2018 | Cherewyk | E21B 41/0021 |
| 2018/0313178 | A1 * | 11/2018 | Biggerstaff | E21B 21/12 |
| 2019/0112884 | A1 * | 4/2019 | Biggerstaff | E21B 21/08 |
| 2020/0141200 | A1 * | 5/2020 | Biggerstaff | E21B 21/065 |
| 2021/0062621 | A1 * | 3/2021 | Biggerstaff | E21B 21/106 |
| 2021/0102432 | A1 * | 4/2021 | Comeaux | E21B 21/106 |

* cited by examiner

DEBRIS CATCH FOR MANAGED PRESSURE DRILLING

CROSS-REFERENCE TO RELATED APPLICATIONS

This application claims priority to and is a continuation in part of U.S. patent application Ser. No. 18/314,589 filed on May 9, 2023 entitled "DEBRIS CATCH FOR MANAGED PRESSURE DRILLING" that is a continuation of U.S. patent application Ser. No. 17/325,835 filed on May 20, 2021 entitled "DEBRIS CATCH FOR MANAGED PRESSURE DRILLING" that issued as U.S. Pat. No. 11,643,889 on May 9, 2023.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

In well drilling, fluids are often pumped into and out of the well. Some of these fluids pumped out of the well could potentially include debris. Such debris could flow from the well and rotating control device (RCD) to components downstream. The debris could potentially damage the components located downstream from the RCD. The present invention installs downstream of the RCD to catch debris to limit damage to the components located downstream from the RCD.

The present invention filters the fluids flowing from the RCD to the components located downstream. Filtering of the fluids limits the debris that flows through the components downstream of the debris catch. The present invention captures the debris to limit damage to the components downstream of the RCD. Sensors, such as pressure transducers, detect the pressure to determine if the flowline is clogged. The operators can then remove and clear the strainer and unclog the flowline.

By reducing the flow of debris from the wellhead to the components, the debris catch increases the life of the components and decreases damage to the component. The debris catch also increases efficiency of the drilling operation and reduces downtime of the drilling operation.

II. Description of the Known Art

Managed pressure drilling operations provide a Coriolis meter downstream of the RCD. No known catch or filter reduces the amount of debris that flows through the Coriolis meter.

SUMMARY OF THE INVENTION

The debris catch of the present invention provides a strainer located downstream of the RCD within the flowline. The strainer is located between the RCD and at least one protected component. The strainer catches debris and other junk that flows from the well. The strainer limits the debris and other junk that flows through protected components located downstream of the strainer.

The strainer is located downstream of the RCD and upstream of the protected component, such as a Coriolis meter. Such a strainer located between the RCD and the protected component limits the debris that flows to the protected component. The strainer may become clogged as the strainer catches debris. The user can then remove the strainer and clean the debris from the strainer. The user may also open a purge valve to purge the debris through a purge outlet located downstream of the strainer.

A sensor, such as at least one pressure sensor, pressure transducer, installed within the drilling system detects the pressure differential to detect clogs within the system. The present invention of one embodiment provides at least two sensors, such as pressure sensors, pressure transducers, installed within the system. A first sensor is located between the RCD and the protected component. The first sensor is located prior to reaching the strainer.

A second sensor is located downstream of the first sensor and downstream of the pathway to the protected component. The pathway of one embodiment may be an outlet that leads to the protected component. In one embodiment, the second sensor is located at the strainer past the protected component. The first and second sensors detect clogs within the strainer. Upon clog detection, personnel may remove the strainer through an access outlet or purge the clog through a purge outlet.

The strainer of one embodiment is positioned within a straining conduit. The straining conduit provides an inlet for the drilling fluid to enter the strainer and the straining conduit. The straining conduit provides a first passageway to the protected component and a second passageway to an access outlet. The first passageway may include a protected outlet that leads to the protected component. The second passageway allows removal of debris from the strainer through an access outlet or purge outlet. In one embodiment, the first pressure sensor is located between the RCD and the protected component. The first pressure sensor may be located between the inlet of the straining conduit and the first passageway to the protected component, such as the protected outlet to the protected component. The first pressure sensor may be located prior to reaching the strainer.

In one embodiment, the protected component is secured to the outlet to the protected component. The second pressure sensor is located downstream (past) the first passageway to the protected component. The second pressure sensor is located between the first passageway and the access outlet. The second pressure sensor of one embodiment may be located at the strainer.

The present invention reduces the downtime and costs of the drilling rig by reducing debris entering protected components.

It is an object of the present invention to catch debris within the drilling fluid.

Another object of the present invention is to protect components located downstream of the strainer.

Another object of the present invention is to provide a release for removing debris from the strainer.

Another object of the present invention is to provide a removable cap for removing the strainer for cleaning and removing the debris.

Another object of the present invention is to provide a purge valve for purging debris from the strainer through a purge outlet.

Another object of the present invention is to protect components in a managed pressure drilling system.

Another object of the present invention is to protect a Coriolis meter.

Another object of the present invention is to create a safer work environment for rig personnel.

In addition to the features and advantages of the debris catch for managed pressure drilling according to the present invention, further advantages thereof will be apparent from the following description in conjunction with the appended drawings.

These and other objects of the invention will become more fully apparent as the description proceeds in the following specification and the attached drawings. These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
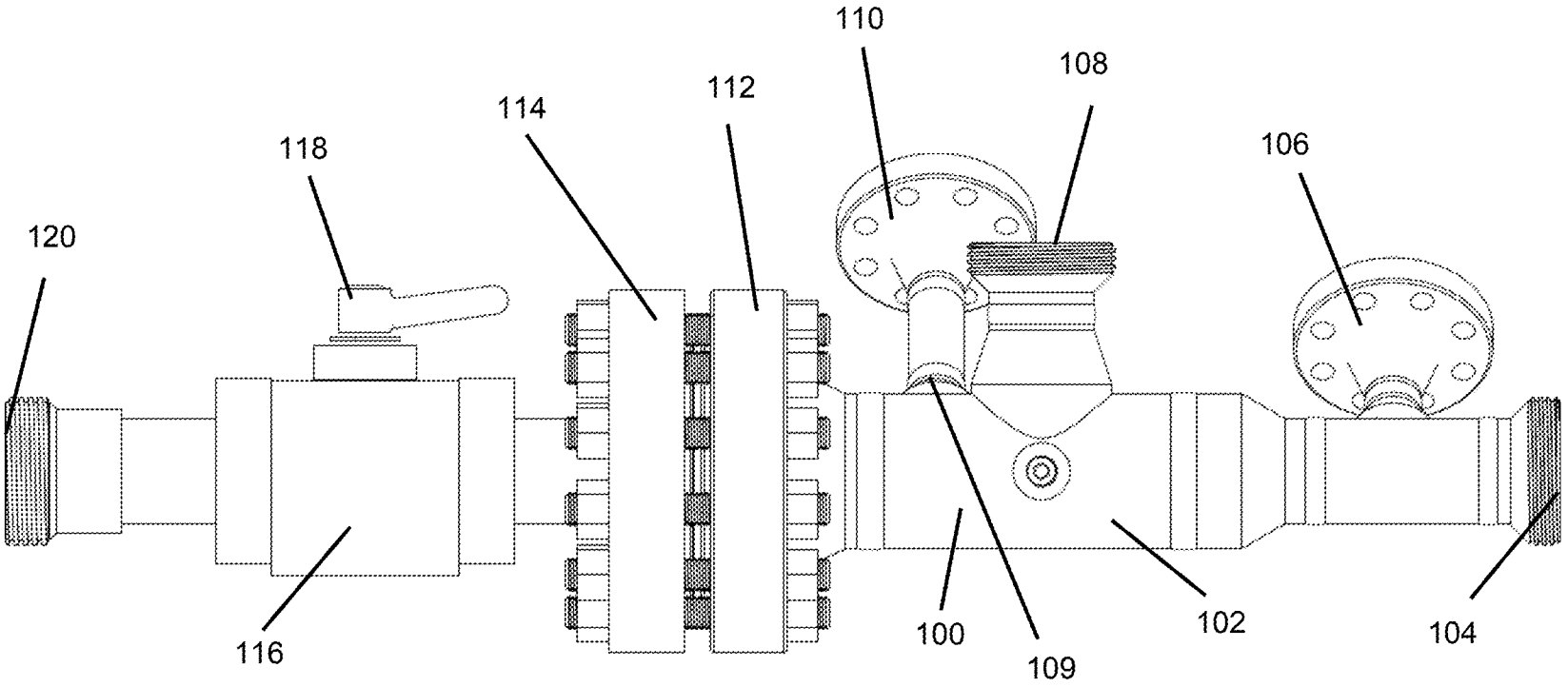
FIG. 1 is a front view showing one embodiment of the present invention.
Figure 2:
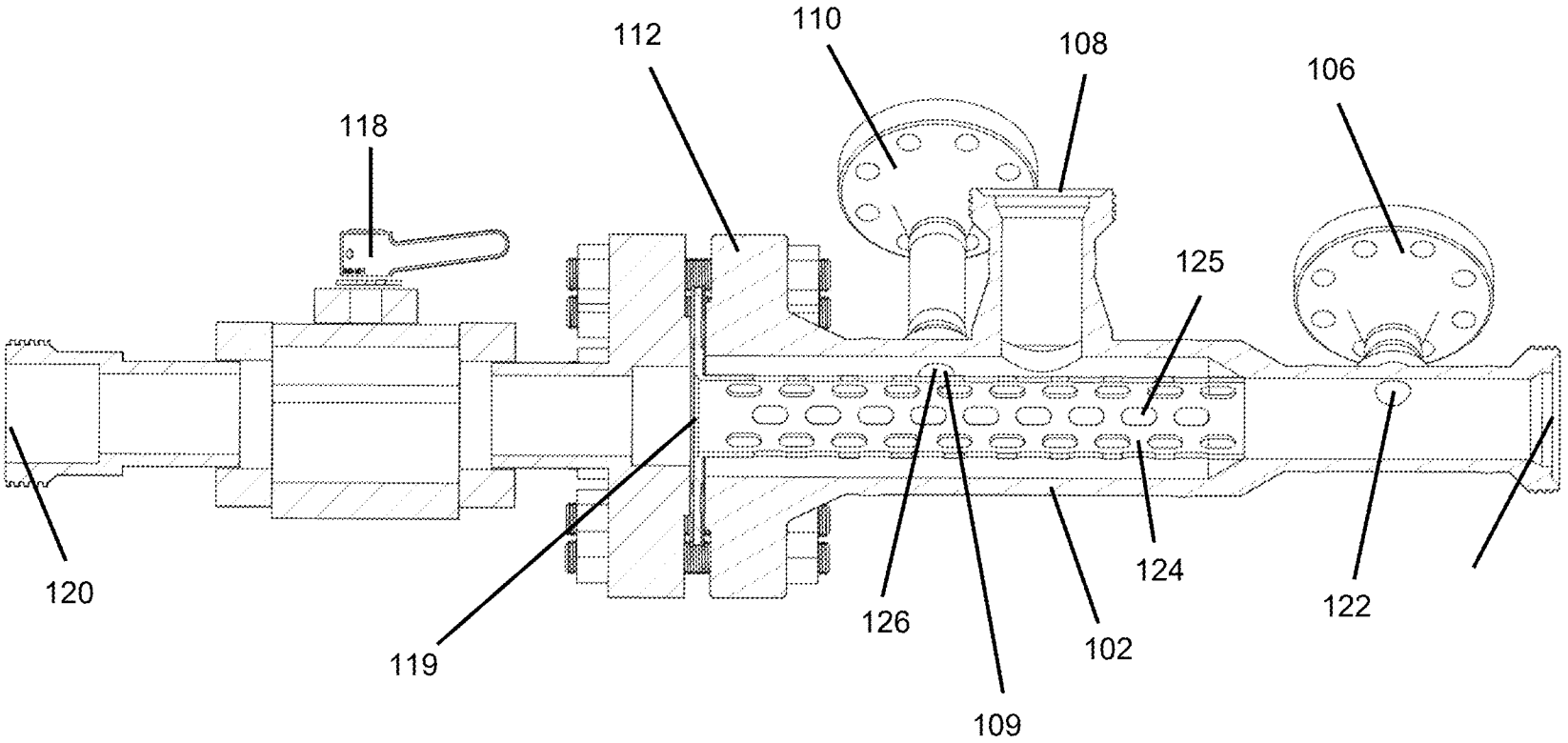
FIG. 2 is a sectional view thereof.

FIGS. 1 and 2 show a debris catch 100 that secures to an outlet in a flowline downstream of a rotating control device (RCD) (not pictured). Drilling fluid from the RCD flows from the RCD to the inlet 104 of the straining conduit 102. The straining conduit 102 houses a strainer 124 that catches debris before the debris reaches a protected component. The debris could potentially damage the component. The strainer 124 catches the debris to limit the amount of debris that flows to the protected component(s). The strainer 124 protects the component located downstream of the strainer 124.

The straining conduit 102 provides two passageways. The first passageway of straining conduit 102 leads to the protected component at protected outlet 108. The second passageway of straining conduit 102 leads to an access outlet 119 or purge outlet 120. The access outlet 119 provides rig personnel with access to the strainer 124. Rig personnel installs and removes the strainer 124 through the access outlet 119.

The purge outlet 120 of one embodiment provides an outlet for purging debris caught by the strainer within the straining conduit 102. The debris is purged from the purge conduit 116 through the purge outlet 120 by opening purge valve 118. The purge outlet 120 directs the debris downstream through a purge path to a debris collection reservoir.

Flange 112 of straining conduit 102 attaches to flange 114 of purge valve 118. Opening purge valve 118 purges debris from the straining conduit 102 through the purge conduit 116. The debris exits the purge conduit 116 through purge outlet 120.

Operation of purge valve 118 may be manual, automated, or both manual and automated. Users may manually open and close the purge valve 118. An actuator (not shown) of one embodiment opens and closes the purge valve 118. The actuator automatically purges the strainer conduit and closes the purge valve 118 to return to normal drilling operations. The system automatically opens the purge valve 118 to purge the strainer conduit. The system then automatically closes the purge valve 118 to return to normal drilling operations. The system may also provide automatic operation with a manual override.

Figure 7:
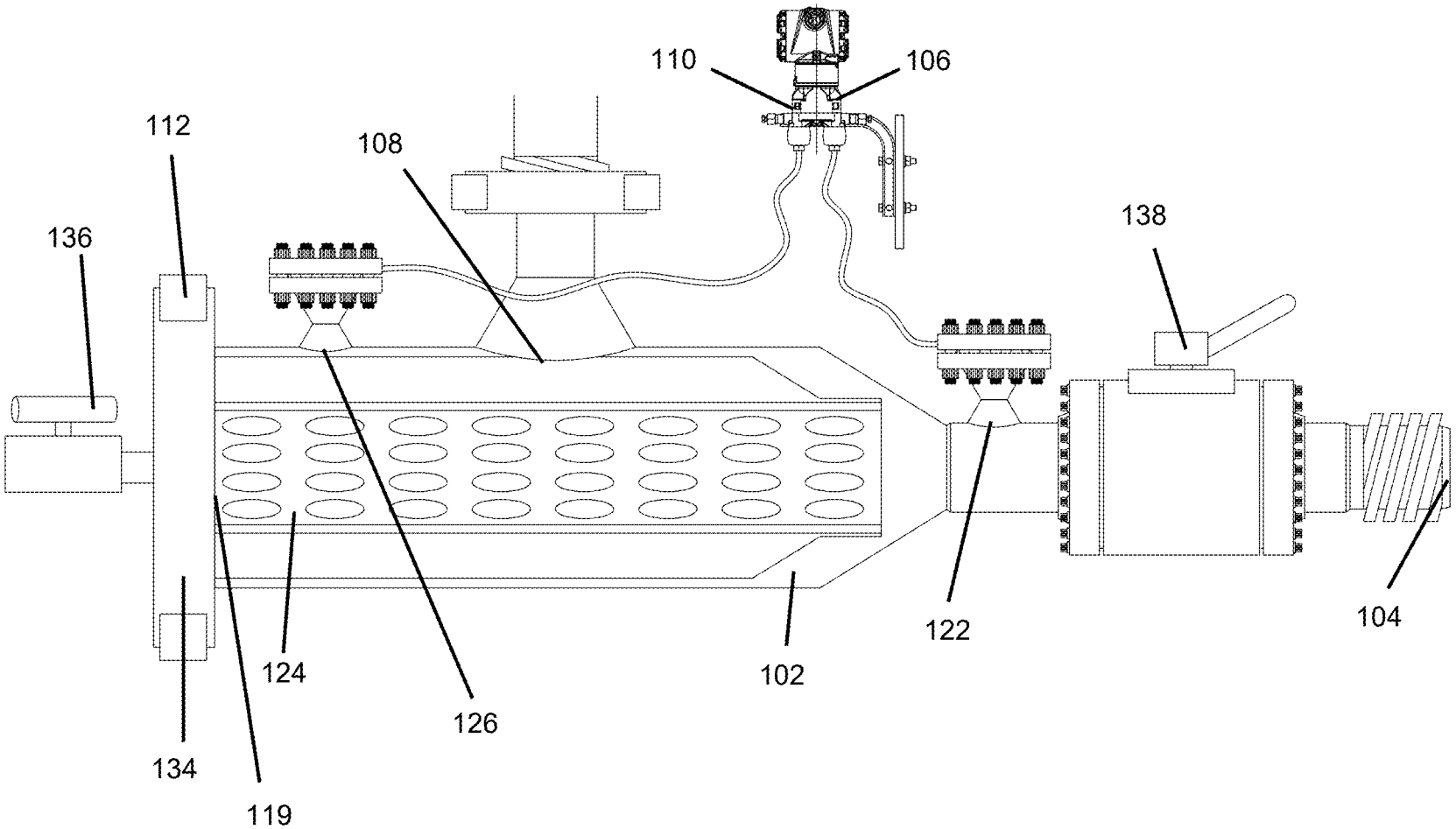
FIG. 7 is a section view of one embodiment of the present invention.

To remove the strainer 124, rig personnel close the isolation valve. Rig personnel may release pressure within the straining conduit through pressure release valve 136. Rig personnel then removes purge valve 118 from straining conduit 102 at flanges 112, 114 or removes cap 134. Rig personnel then removes strainer 124 from straining conduit 102 through the access outlet 119 in flange 112. The rig personnel clean the strainer 124 and installs the strainer 124 into straining conduit 102 through the access outlet 119 in flange 112 as shown in FIGS. 2 and 7. Rig personnel opens isolation valve for continued drilling operations to allow drilling fluid to flow to the strainer and straining conduit.

Figure 3:
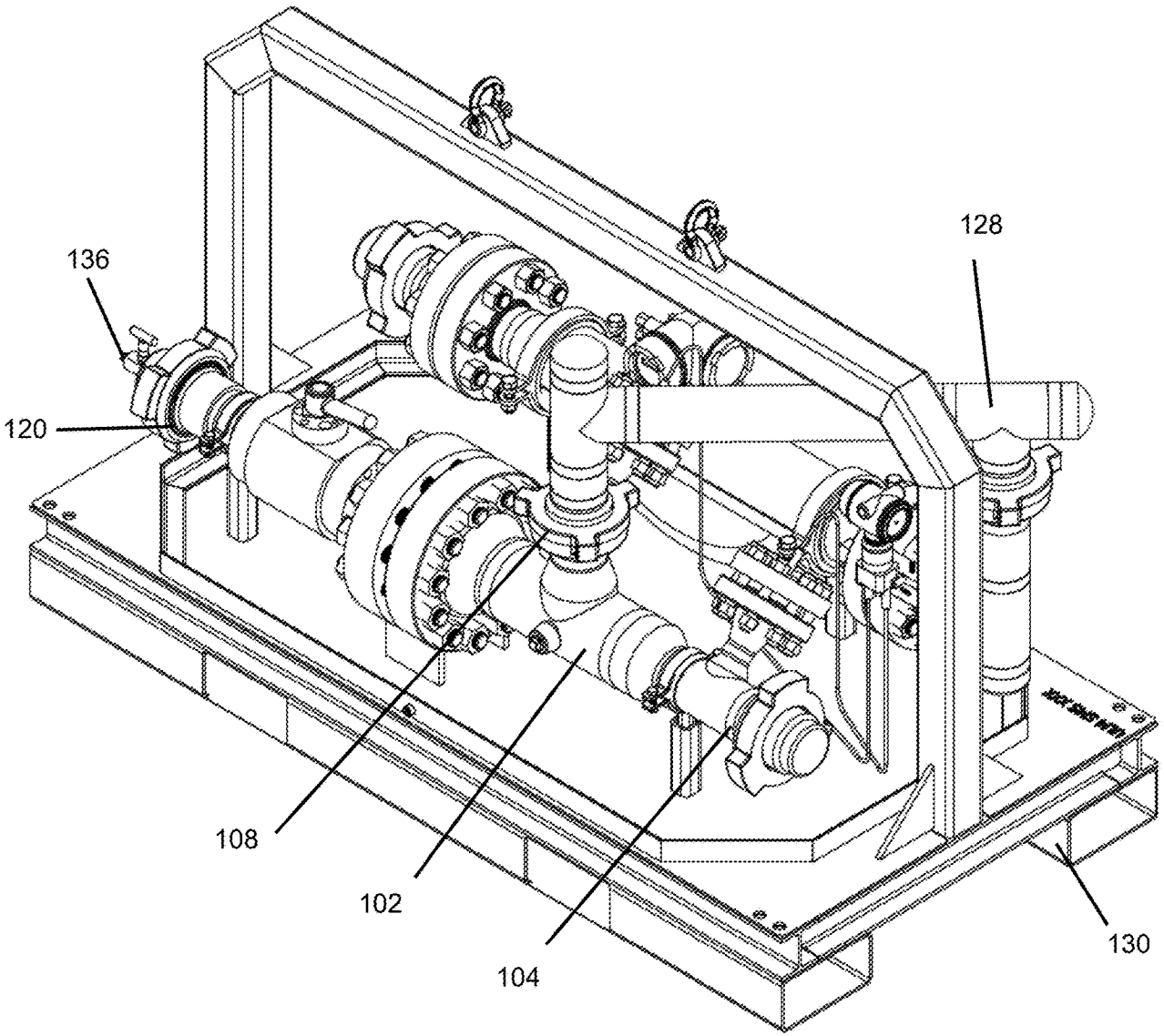
FIG. 3 is a perspective environmental view thereof.
Figure 4:
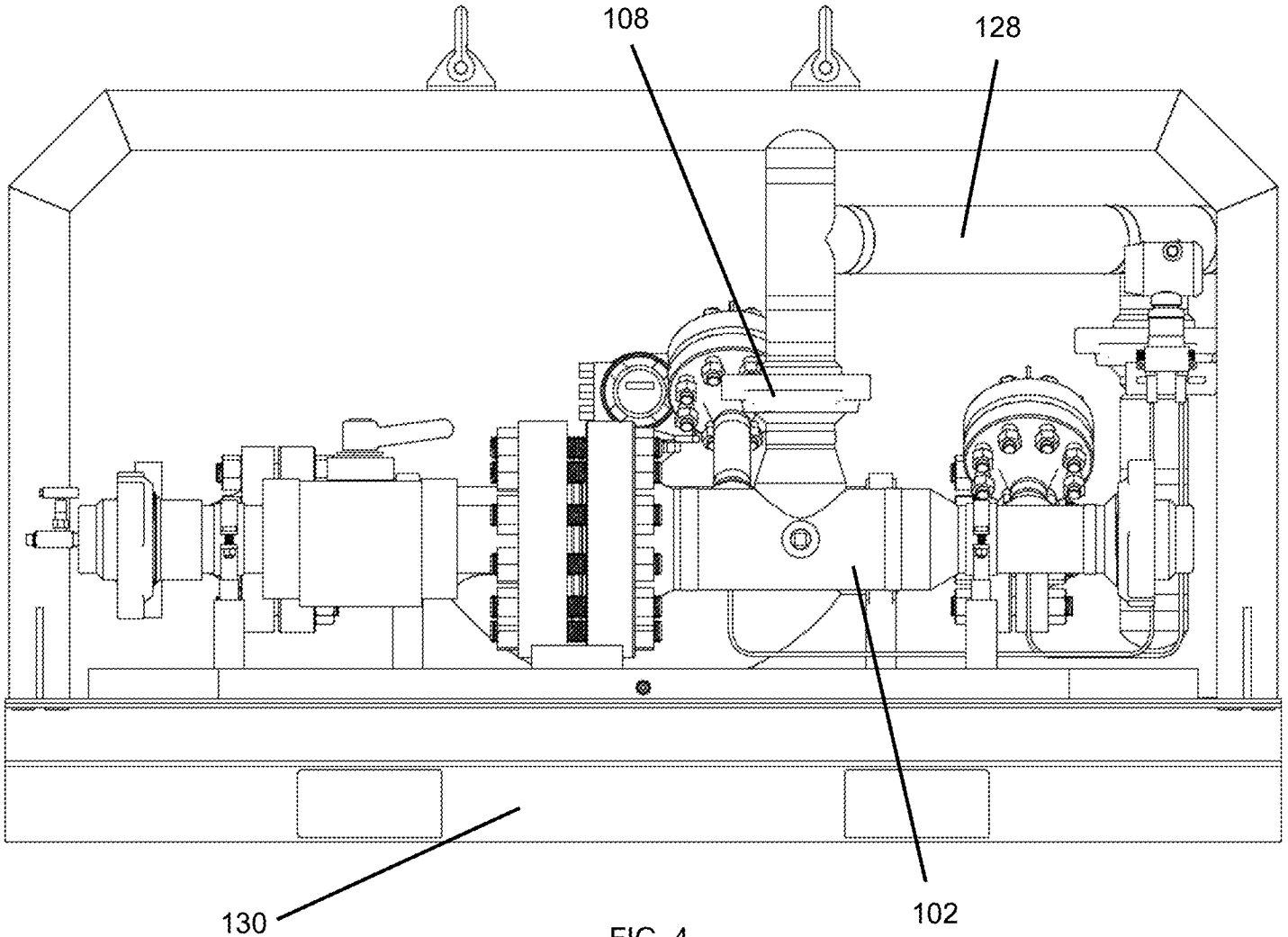
FIG. 4 is a front environmental view thereof.

In one embodiment, rig personnel may require relieving pressure from the system prior to removing the purge conduit 116 from the straining conduit 102. Pressure release valve 136 as shown in FIGS. 3 and 7 discharges the pressure within the system to reduce the pressure within the system. Rig personnel may then remove the purge conduit 116 from the straining conduit 102. Rig personnel may then remove, clean, and install strainer 124 within the straining conduit 102.

The strainer 124 within straining conduit 102 catches debris before the debris reaches a component within the passageways through protected outlet 108 and outlet 109 at sensor 110. The strainer 124 protects the components located downstream within the first passageway through protected outlet 108 and outlet 109 at sensor 110. The protected components may include, but are not limited to, Coriolis meter, flow control devices, and other rig equipment.

FIGS. 1 and 2 also show the placement of the sensors 106, 110, such as pressure transducers, that detect the pressure within the straining conduit 102. The sensors 106, 110 may be positioned differently. First sensor 106 detects the pressure of the drilling fluid prior to reaching the strainer 124 and the protected outlet 108. First sensor 106 detects the pressure at detection point 122. Second sensor 110 detects the pressure at detection point 126. Second sensor 110 detects the pressure at the strainer 124 in the second passageway towards access outlet 119 and purge outlet 120 past the protected outlet 108. Detecting pressure after protected outlet 108 in the second passageway away from the protected component, the second sensor 110 detects clogs within the strainer 124.

The strainer 124 is located in the straining conduit 102 at the first passageway to the protected component via outlet 108. The strainer 124 catches debris prior to protected outlet 108 and the protected component. Straining apertures 125 with the strainer 124 allow the drilling fluid to pass through the strainer 124. The straining apertures 125 limit the debris that can flow through the strainer 124.

The strainer 124 catches debris from the drilling fluid through the first passageway to the protected component. The strainer 124 limits the debris that reaches the protected component. As the strainer 124 catches the debris, rig personnel may remove a cap 134 or connection to the flange 112 of the straining conduit 102, such as purge conduit 116, to remove the strainer through the access outlet 119 of flange 112 shown in FIGS. 2 and 7. As discussed above, rig personnel may release pressure through pressure release valve 136 shown in FIGS. 3 and 7 prior to removing the cap 134 or connection, such as purge conduit 116. Rig personnel may then clean the strainer 124 to remove the debris and install a strainer 124 into the straining conduit 102.

The first sensor 106 detects the pressure at detection point 122 located upstream of the strainer 124. The first sensor 106 detects the pressure of the drilling fluid prior to reaching the strainer 124 and the protected component. The second sensor 110 detects the pressure of the drilling fluid at the strainer 124. The second sensor 110 also detects the pressure of the drilling fluid delivered through the first passageway and the protected outlet 108 to the protected component.

The system detects clogs via the first sensor 106 and the second sensor 110. The first sensor 106 detects pressure prior to reaching the strainer 124. The second sensor 110 detects the pressure after reaching the strainer 124 and outlet 109 and before reaching the protected component via first passageway and outlet 108.

During clogged conditions, the second sensor 110 detects a drop in pressure at the detection point 126. The first sensor 106 detects a spike in pressure at detection point 122. The second sensor 110 detects a lower pressure approaching zero (0) or near zero (0) during the clogged conditions. Meanwhile, the first sensor 106 detects a constantly increasing pressure as the pressure spikes at first sensor 106 during the clogged conditions.

The straining conduit 102 provides two different options for removing debris from the strainer 124 and the straining conduit 102. One option allows for releasing the debris by opening a purge valve 118 to release the debris through purge conduit 116 and purge outlet 120. Opening purge valve 118 releases the debris without removing the strainer 124 from straining conduit 102.

In one embodiment, an actuator automatically opens the purge valve 118 after detecting the clog. A sensor, such as a differential pressure transducer, or multiple sensors detect the pressure at the first detection point 122 located upstream of the strainer and a second detection point 126 located downstream from at least a portion of the strainer. Pressures detected at the first detection point 122 and the second detection point 126 identify potential clogs at the strainer and the strainer conduit as discussed above. The system of one embodiment instructs the actuator to automatically open and close the purge valve 118 after detecting the clogged condition through the pressure readings at first detection point 122 and second detection point 126. After the clog is detected by the sensor(s), the actuator automatically opens the purge valve 118 to direct the drilling fluid through the purge path to the debris collection reservoir. The system may maintain the purge valve 118 in the open position for a designated purge time to purge the strainer conduit. In another embodiment, the system maintains the purge valve 118 open until the pressure at the detection points 122, 126 indicate that the clog is cleared.

Another option requires rig personnel to remove a cap 134 or purge valve 118 at flange 112 of the straining conduit 102 as shown in FIGS. 1, 2, and 7. Rig personnel then removes the strainer 124 from the straining conduit 102 through the access outlet 119. Rig personnel may clean the strainer 124 and the inside of the straining conduit 102 to remove the debris. Rig personnel then installs the cleaned strainer 124 into the straining conduit 102 and reattaches the cap 134 or purge valve 118 at flange 112. Drilling operations can then continue.

FIGS. 3-6 show straining conduit 102 and Coriolis meter 128 secured to skid 130. Skid 130 simplifies installation of the straining conduit 102 and the Coriolis meter 128. The flow line connects to inlet 104. Drilling fluid flow flows from the RCD (not pictured) into the inlet 104. The drilling fluid flows through the first passageway and protected outlet 108 to the Coriolis meter 128. As discussed above, debris can be removed from the straining conduit 102 by opening the purge valve to release the debris through the purge outlet 120.

Figure 5:
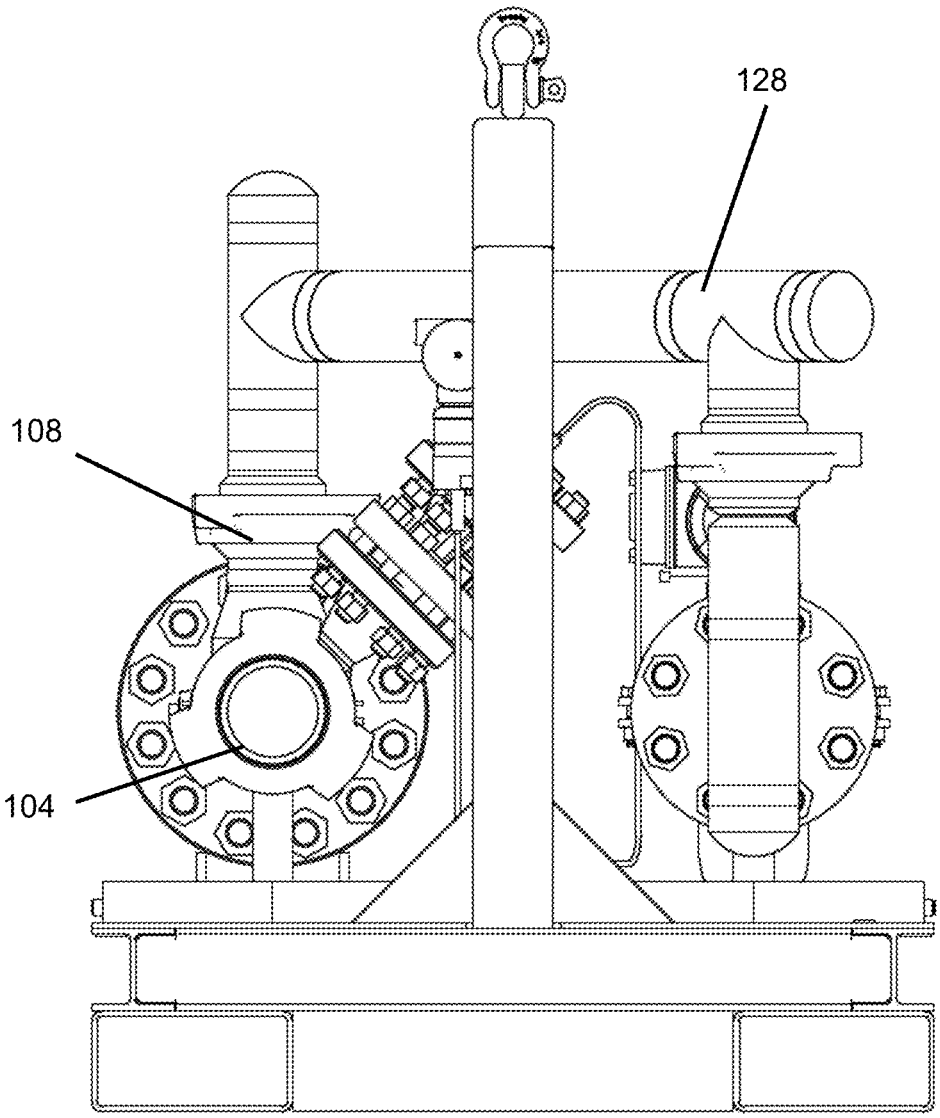
FIG. 5 is a right side environmental view thereof.

FIG. 5 shows the inlet 104 covered by a cap for protection. The cap is removed to attach the flow line to the inlet 104 and the straining conduit 102. The drilling fluid flows into the inlet 104 through the straining conduit into the Coriolis meter 128.

Figure 6:
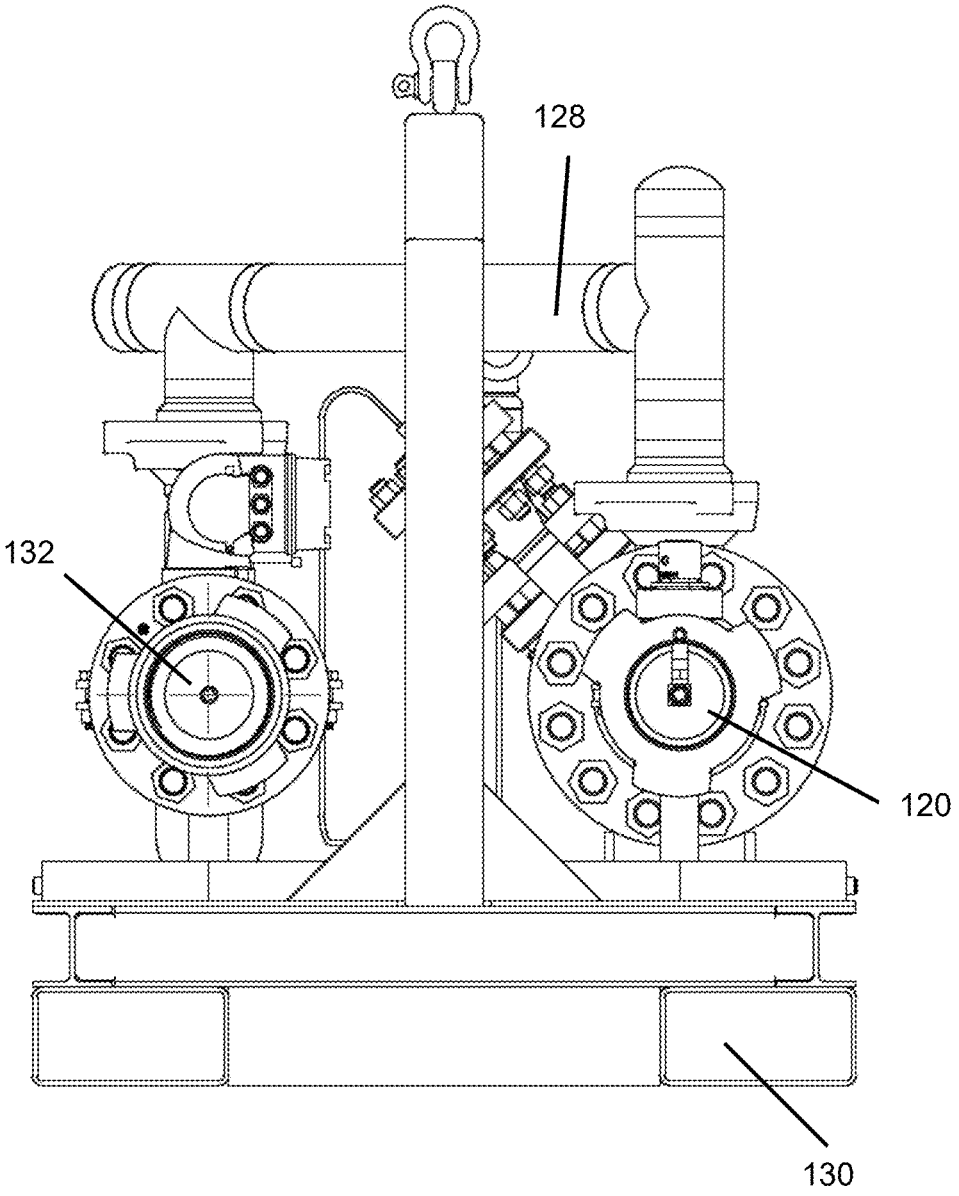
FIG. 6 is a left side environmental view thereof.

FIG. 6 shows the outlet 132 and the Coriolis meter 128. The drilling fluid flows through the straining conduit 102 into the Coriolis meter 128. The drilling fluid exits the Coriolis meter 128 and flows out the outlet 132.

FIG. 7 shows another embodiment of debris catch that provides isolation valve 138 at inlet 104. Isolation valve 138 enables isolating straining conduit 102 and strainer 124 from the MPD system. Upon detection of a clog by sensors 106, 110 that detect pressure at detection points 122, 126, rig personnel may close valve 138. Rig personnel closes the valve 138 to remove and clean the strainer 124 from the straining conduit 102.

Isolation valve 138 remains open during normal operation of the strainer 124 and straining conduit 102. Drilling fluid flows into the inlet 104 through the strainer 124. The drilling fluid flows from the strainer 124 through the outlet 108 to the protected component. Rig personnel installs the strainer 124 into the straining conduit 102 to continue protecting the protected component(s).

Sensors 106, 110 detect a clog in the strainer 124 and straining conduit 102. Rig personnel close isolation valve 138 to remove cap 134 from the straining conduit 102. The valve 138 isolates the straining conduit 102 for removal of the cap 134. The pressure within the straining conduit 102 can be released through pressure release valve 136. Rig personnel then remove cap 134 to access the strainer 124. Rig personnel can then remove the strainer 124 for cleaning. Rig personnel then installs a strainer 124 into the straining conduit and reattaches cap 134 for continued protection of protected outlet 108. Rig personnel opens the isolation valve 138 to continue drilling operations.

Isolation valve 138 may also be present in the embodiment shown in FIGS. 1-6. Closing the isolation valve 138 for the embodiment shown in FIGS. 1-6 allows for removal of the straining conduit to access the strainer.

The debris catch of the present invention catches debris within a strainer. The debris catch is located upstream of the protected component to limit the flow of debris to the protected component. Sensors detect clogs within the strainer to allow rig personnel to clear the clog within the strainer. Rig personnel may flush the clog through a purge outlet by opening a purge outlet located downstream of the strainer. Rig personnel may also manually clear the clog by removing the strainer, clearing the clog, and reinstalling a strainer. The debris catch may protect components including Coriolis meter, flow control devices, and other rig equipment.

An isolation valve located upstream of the strainer remains open during drilling operations. The isolation valve allows drilling fluid to flow to the strainer. Closing the isolation valve limits the flow of the drilling fluid to the strainer. Closing the isolation valve enables rig personnel to remove and install the strainer within the straining conduit.

A purge valve located downstream of the strainer allows purging of the clog through a purge outlet. The purge valve remains closed during drilling operations. Closing the access outlet and purge outlet directs the drilling fluid to the protected component and the protected outlet in the first passageway. Opening the purge valve directs the drilling fluid out the access outlet and the purge outlet to purge the clog through the purge outlet.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A debris catching system located downstream of a rotating control device (RCD) in a drilling operation that catches debris from drilling fluid to protect a component, the system comprising:

a straining conduit configured to secure to the RCD for flow of the drilling fluid from the RCD through the straining conduit;

a strainer located within the straining conduit;

a protected outlet in the straining conduit located downstream of at least a portion of the strainer;

a purge outlet in the straining conduit, wherein the purge outlet is downstream from the protected outlet and the strainer;

a first sensor that detects the pressure of the drilling fluid at a first detection point upstream of the strainer;

wherein the first sensor detects pressure of the drilling fluid at a second detection point located downstream of at least a portion of the strainer.

2. The system of claim 1 further comprising:

a pressure release valve located downstream of the access purge outlet and the protected outlet, wherein the pressure release valve is in communication with the straining conduit, wherein opening the pressure release valve releases pressure from the straining conduit.

3. The system of claim 1 further comprising:

a debris collection reservoir connected to the purge outlet, wherein the drilling fluid flows through the purge outlet to the debris collection reservoir.

4. A debris catching system located downstream of a rotating control device (RCD) in a drilling operation that catches debris from drilling fluid to protect a component, the system comprising:

a straining conduit configured to secure to the RCD for flow of the drilling fluid from the RCD through the straining conduit;

a strainer located within the straining conduit, wherein the strainer extends longitudinally through the straining conduit;

a protected outlet in the straining conduit located downstream of at least a portion of the strainer;

a purge outlet in the straining conduit, wherein the purge outlet is downstream from the protected outlet and the strainer, wherein the purge outlet longitudinally aligns with the strainer;

a first sensor that detects the pressure of the drilling fluid at a first detection point upstream of the strainer;

wherein the first sensor detects pressure of the drilling fluid at a second detection point located downstream of at least a portion of the strainer.

5. The system of claim 4 further comprising:

an isolation valve located upstream of the strainer, wherein the drilling fluid flows past the isolation valve prior to reaching the strainer.

6. A debris catching system located downstream of a rotating control device (RCD) in a drilling operation that catches debris from drilling fluid to protect a component, the system comprising:

a straining conduit configured to secure to the RCD for flow of the drilling fluid from the RCD through the straining conduit;

a strainer located within the straining conduit;

a protected outlet in the straining conduit located downstream of at least a portion of the strainer;

a purge outlet in the straining conduit, wherein the purge outlet is downstream from the protected outlet and the strainer;

wherein the purge outlet is sized to accept the strainer, wherein the purge outlet is located downstream from the strainer installed in the straining conduit, wherein the strainer installs into the straining conduit through the purge outlet; and a cap configured to secure to the straining conduit to cover the purge outlet, wherein removal of the cap enables installation and removal of the strainer within the straining conduit.

7. The system of claim 6 further comprising:

at least one pressure sensor detecting pressure at a first detection point and a second detection point, wherein the first detection point is located upstream of the strainer and the second detection point is located downstream of at least a portion of the strainer.

8. The system of claim 7, wherein the strainer extends longitudinally through the straining conduit;

wherein the purge outlet longitudinally aligns with the strainer;

wherein removing the cap directs drilling fluid longitudinally past the strainer through the purge outlet.

9. The system of claim 6, wherein detaching the cap from the straining conduit is required to remove the strainer from the straining conduit.

10. The system of claim 6, wherein the cap secures the strainer within the straining conduit.

11. The system of claim 6, wherein the cap directly contacts the strainer to secure the strainer within the straining conduit.

12. The system of claim 6, wherein the cap is directly downstream of the strainer.

13. The system of claim 6, wherein no flow control device separates the cap from the strainer.

14. The system of claim 6, wherein the cap is located downstream of the straining conduit and the protected outlet.

15. The system of claim 6, wherein the cap is configured to secure directly to the straining conduit.

* * * * *